US010502031B2

(12) United States Patent
Winters

(10) Patent No.: US 10,502,031 B2
(45) Date of Patent: Dec. 10, 2019

(54) METHOD AND APPARATUS FOR PRODUCING GAS FROM A FORMATION CONTAINING BOTH GAS AND WATER

(71) Applicant: Charles W. Winters, Bradenton, FL (US)

(72) Inventor: Charles W. Winters, Bradenton, FL (US)

( * ) Notice: Subject to any disclaimer, the term of this patent is extended or adjusted under 35 U.S.C. 154(b) by 135 days.

(21) Appl. No.: 15/700,214

(22) Filed: Sep. 11, 2017

(65) Prior Publication Data

US 2018/0073334 A1 Mar. 15, 2018

Related U.S. Application Data

(60) Provisional application No. 62/393,041, filed on Sep. 11, 2016.

(51) Int. Cl.
*E21B 43/08* (2006.01)
*E21B 43/38* (2006.01)

(52) U.S. Cl.
CPC ..... *E21B 43/086* (2013.01); *E21B 43/38* (2013.01); *E21B 43/084* (2013.01)

(58) Field of Classification Search
CPC ..... E21B 43/086; E21B 43/084; E21B 43/38
See application file for complete search history.

(56) References Cited

U.S. PATENT DOCUMENTS

| | | | | |
|---|---|---|---|---|
| 1,731,366 | A | 10/1927 | Windsor | |
| 2,035,758 | A | 3/1936 | Pierce | |
| 2,640,545 | A | 6/1953 | Share | |
| 2,877,852 | A | 3/1959 | Bashara | |
| 3,099,318 | A | 7/1963 | Miller | |
| 4,171,017 | A | 10/1979 | Klass | |
| 4,241,787 | A | 12/1980 | Price | |
| 5,673,752 | A | 10/1997 | Scudder | |
| 2008/0105598 | A1 * | 5/2008 | Fisher | B07B 1/46 209/402 |

* cited by examiner

*Primary Examiner* — Brad Harcourt
(74) *Attorney, Agent, or Firm* — Thomas K. Ziegler

(57) ABSTRACT

A downhole filter tool is placed in a wellbore for separating gas from a solution containing both gas and water in a subterranean hydrocarbon bearing formation. The filter tool includes a filter bag inserted inside a perforated inner tube that is surrounded by a casing. The filter bag comprises a layer of hydrophobic material that allows gas to be separated from the water.

16 Claims, 4 Drawing Sheets

METHOD AND APPARATUS FOR PRODUCING GAS FROM A FORMATION CONTAINING BOTH GAS AND WATER

CROSS REFERENCE TO RELATED APPLICATIONS

This application claims the benefit of Provisional U.S. Patent Application No. 62/393,041 filed Sep. 11, 2016, the entirety of which prior application is incorporated by reference herein.

BACKGROUND INFORMATION

1. Field

The present disclosure generally relates to gas well production, and deals more particularly with a method and apparatus for separating water from gas within a wellbore, such that only gas is produced at the surface.

2. Background

In a typical gas production well, the subterranean formation often includes gas that is in solution with water. In order to extract the gas from the water, the solution is pumped to the surface where extensive separation processes are employed to separate the gas from the water. It is then necessary to dispose of water, often requiring that it be directed into separate disposal wells. The need for separation processes, related equipment and disposal wells may drive up production costs to the point that some gas wells may not be economically viable even though they contain considerable gas reserves.

Devices for separating water from gas downhole within a well have been developed using a separation filter, but none of these devices has been entirely successful for various, including poor efficiency and/or a lack of durability. Accordingly, there is a need for a method and apparatus for separating water from gas downhole within a well that are highly efficient, compact while being simple and durable.

SUMMARY

The disclosure relates in general to separating gas from a solution containing both gas and water, and more specifically to a method and apparatus for performing the separation downhole within a well.

According to one aspect, apparatus is provided for separating gas from a solution containing gas and water in a well. The apparatus comprises a filter bag and a tube sleeved over the filter bag. The filter bag has an open end allowing the solution to be received under hydrostatic pressure into the interior of the filter bag. The filter bag includes a filtering material configured to separate the gas from the water. The tube has an open end into which the filter bag may be received, and plurality of perforations therein configured to allow the gas to escape from the tube.

According to another aspect, a wellbore tool is provided, comprising a perforated intake tube, a perforated inner tube, a filter bag and a casing. The perforated intake tube defines an inner chamber configured to receive a solution containing gas and water within a well. The perforated inner tube is attached to the perforated intake tube for receiving the solution from the intake tube into the inner chamber. The filter bag lines the inner chamber within the perforated inner tube, and includes filtering material for separating the gas from the water. The casing surrounds the perforated inner tube and defines an outer chamber in which the gas separated by the filter bag is accumulated.

According to still another aspect, a method is provided of separating gas from a liquid within a subterranean well formation. The method includes placing a gas filter bag inside a perforated tube, and receiving the liquid within the well formation into an open end of the bag using hydrostatic pressure within the well formation. The method also includes using the perforated tube as a backing for the filter bag, including using the perforated tube to react the hydrostatic pressure, and using the filter bag to separate the gas from the liquid. The method further includes passing the gas separated by the filter bag through the perforated tube.

One of the advantages of the disclosed method and apparatus is that a filter tool is employed that is simple in design, compact, and durable. Another advantage is that the filter tool is highly efficient in separating gas from water. A further advantage is that the filter tool may be easily manufactured with dimensions to suit the size of the wellbore and application. Another advantage is that the filter tool is made of lightweight yet strong metal components. Another advantage is that the filter tool employs a casing that can be welded to a gas pipe, assuring a strong connection between the gas pipe and the tool in order to prevent the tool from being separated from the pipe. Still another advantage is that the filter tool is of a variable compact design, allowing it to be employed in shallow operation zones at lower levels of hydrostatic pressure. Yet another advantage is that the filter tool employs a construction that provides internal support to a semi-permeable membrane used to separate water from gas.

The features, functions, and advantages can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and advantages thereof, will best be understood by reference to the following detailed description of an illustrative embodiment of the present disclosure when read in conjunction with the accompanying drawings, wherein:

DETAILED DESCRIPTION

Figure 1:
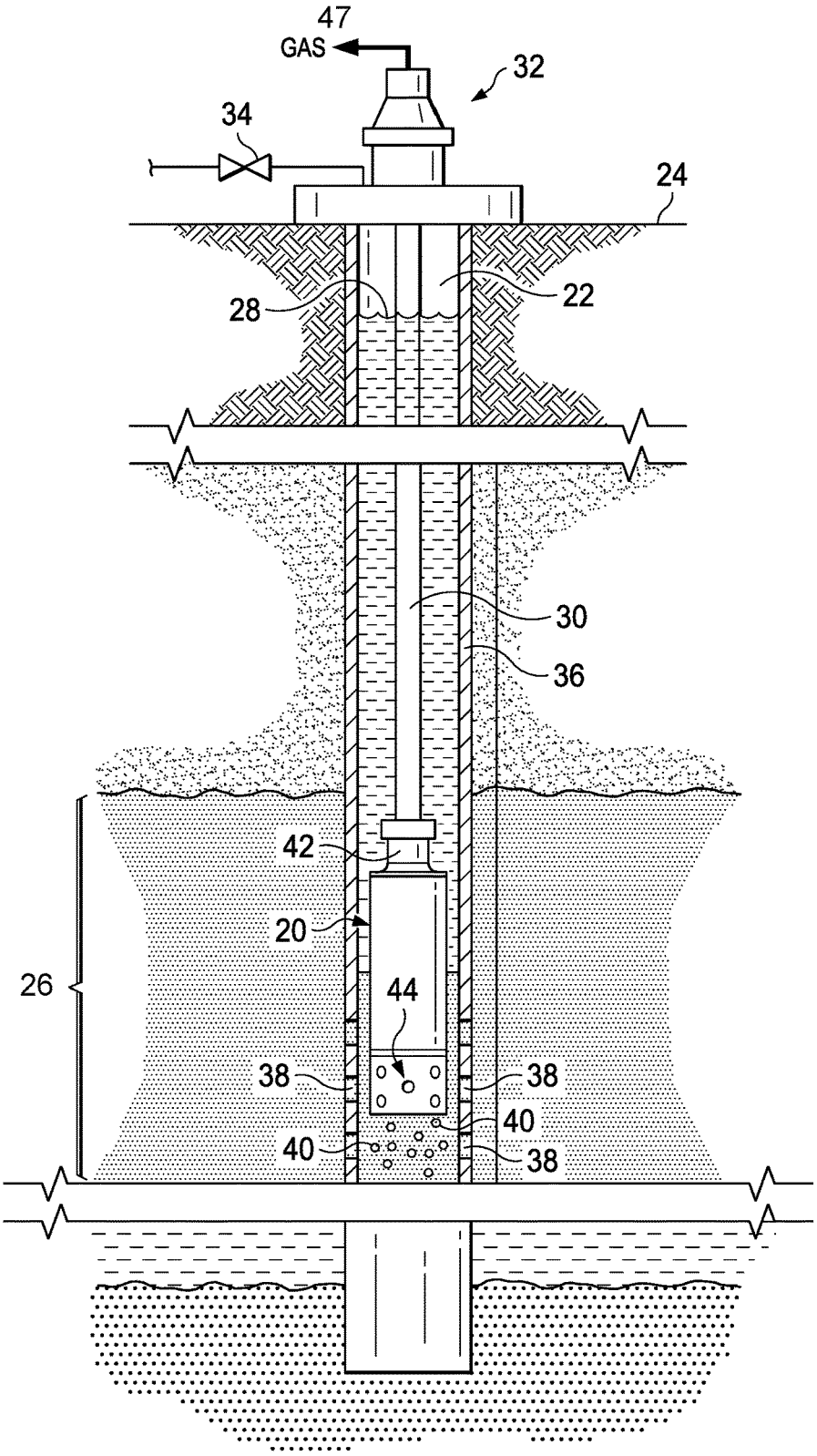
FIG. 1 is an illustration of a vertical, sectional view of a wellbore extending into a subterranean formation that contains gas, showing the filter tool in elevation.

Referring first to FIG. 1, the disclosed embodiments relate to a filter tool 20 that may be inserted into a wellbore 22 having an outer casing 36. Wellbore 22 extends from ground level 24 a subterranean, hydrocarbon bearing formation 26, such as a formation that produces gas in solution 40 with water, typically brine. The bottom of the casing 36 contains perforations 38 that allow the solution 40 within the formation 26 to enter the casing 36. The filter tool 20 is positioned at a desired level within the formation 26 and functions to filter and thereby separate the gas from the water within the wellbore 22. The water builds up to a level 28 that produces hydrostatic pressure within the wellbore 22. The hydrostatic pressure forces the solution 40 into an intake 44 in the filter tool 20. A wellhead 32 of conventional construction having a gas outlet 47 is coupled by a gas pipe 30 which channels gas coming out of solution within the filter tool 20 to the ground level 24. The gas pipe 30 is connected to the filter tool 20 by a pipe coupler 42 at the top of the filter tool 20. Depending on the application, a pressure regulator 34 may be provided to relieve or maintain pressure within the wellbore 22 above the water level 28.

Figure 2:
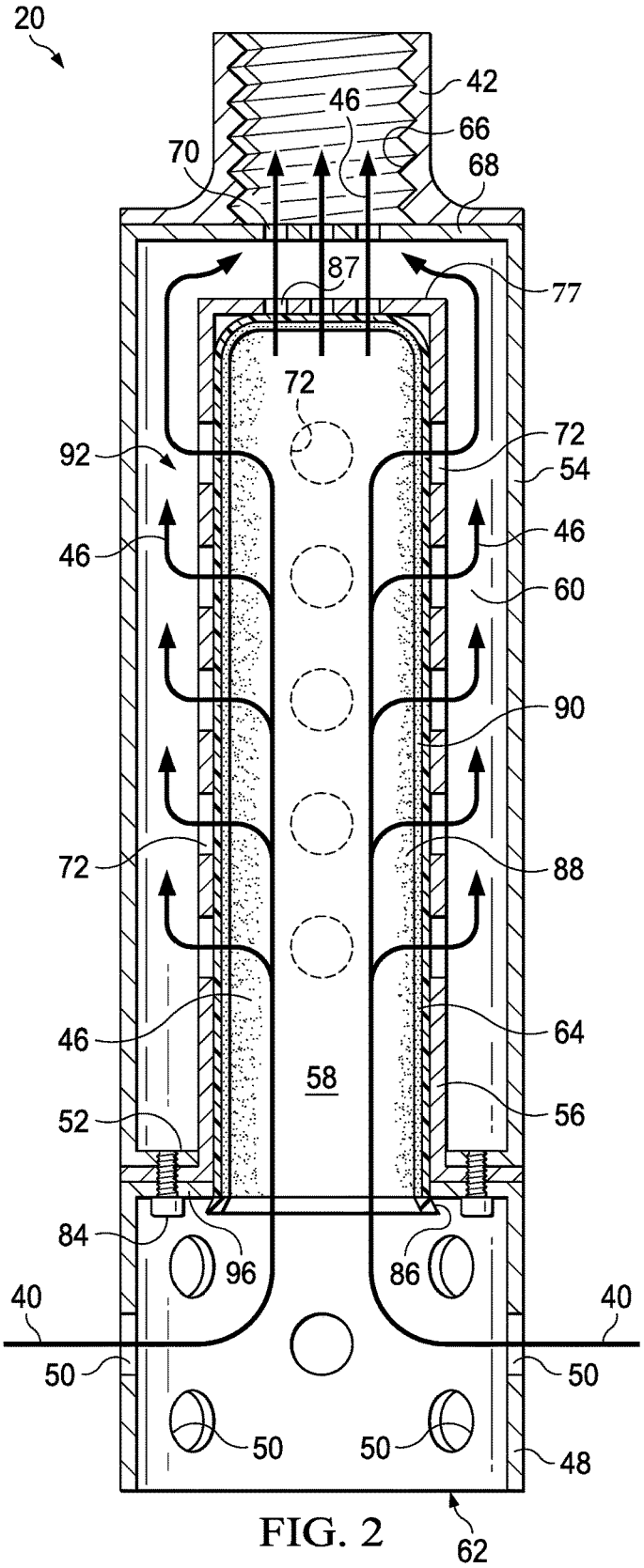
FIG. 2 is an illustration of a longitudinal sectional view of the filter tool shown in FIG. 1.
Figure 3:
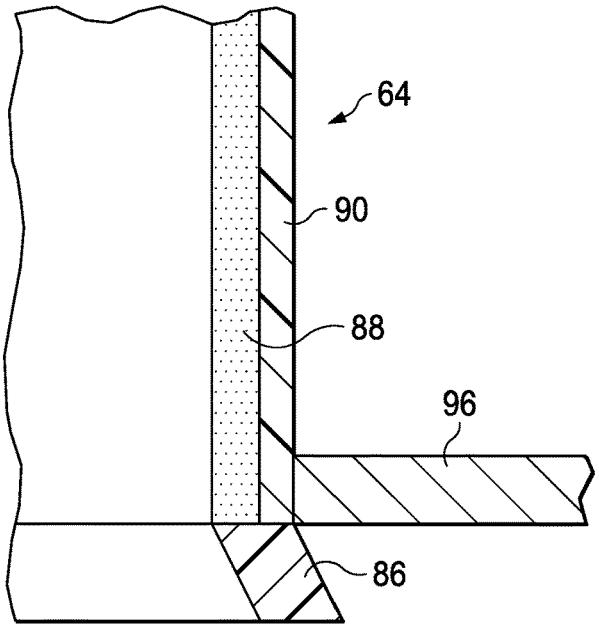
FIG. 3 is an illustration of a sectional view taken through the filter bag, showing the mouth of the bag seated against an internal flange within the filter tool.
Figure 3A:
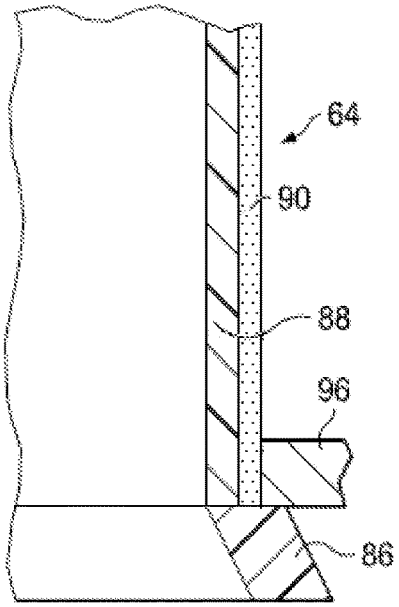
FIG. 3A is an illustration similar to FIG. 3, but showing an alternate embodiment of the filter bag.

Attention is now directed to FIGS. 2, 3, 3A and which illustrate additional details of the filter tool 20. The filter tool 20 broadly comprises a cylindrically shaped outer casing 54, a cylindrically shaped inner tube 56, a filter bag 64, and an intake tube 48. The outer casing 54 is substantially hollow and includes a closed top having perforations, which in the illustrated example, comprising series of centrally located slots 70. The closed top 68 with slots 70 prevents any debris that might enter the gas pipe 30 from falling down into the filter tool 20, while allowing gas to exit up into the gas pipe 30. The bottom of the outer casing 54 is provided with an annular flange 52. The outer casing 54 may be formed of a suitable metal such as aluminum that is strong, yet lightweight. As best seen in FIG. 2, the pipe coupler 42 is secured to the closed top 68 of the outer casing 54 by any suitable means, such as by welding. In the illustrated example, the pipe coupler 42 is provided with internal threads 66 that allow filter to 20 to be screwed onto matching threads (not shown) on the bottom of the gas pipe 30. In other examples, however, the bottom of the gas pipe 30 may be welded to the pipe coupler 42.

The cylindrically shaped inner tube 56 has a diameter that is less than that of the outer casing 54, thereby forming an annular gap, hereinafter be referred to as a low pressure, outer chamber 60, 92 between the inner tube 56 and the outer casing 54. The outer chamber 60, 92 extends to the open space between the top end 77 of the inner tube 56 and the top 68 of the outer casing 54. The inner tube 56 has an open bottom end 74 and a closed top end 77 provided with a plurality of openings therein, which may be in the form of slots 87. The slots 87 may or may not be aligned with the slots 70 in the closed top 68 of the outer casing 54. The closed top end 77 of the inner tube 56 prevents any debris falling down into the inner chamber 58 that may enter the filter tool 20 from the gas pipe 30 above. The inner tube 56 further includes a plurality of longitudinally and circumferentially spaced apart perforations 72 therein, and an annular, radially extending flange 82 that is adapted to fit flush against the annular flange 52 at the bottom of the on the outer casing 54. As best seen in FIG. 2, the closed top end 77 of the inner tube 56 is slightly spaced below the closed top 68 of the outer casing 54, forming a portion of the outer chamber 92 between the closed tops 68. 77. The inner tube 56 may be formed of a suitable rigid and durable metal material such as aluminum.

Figure 4:
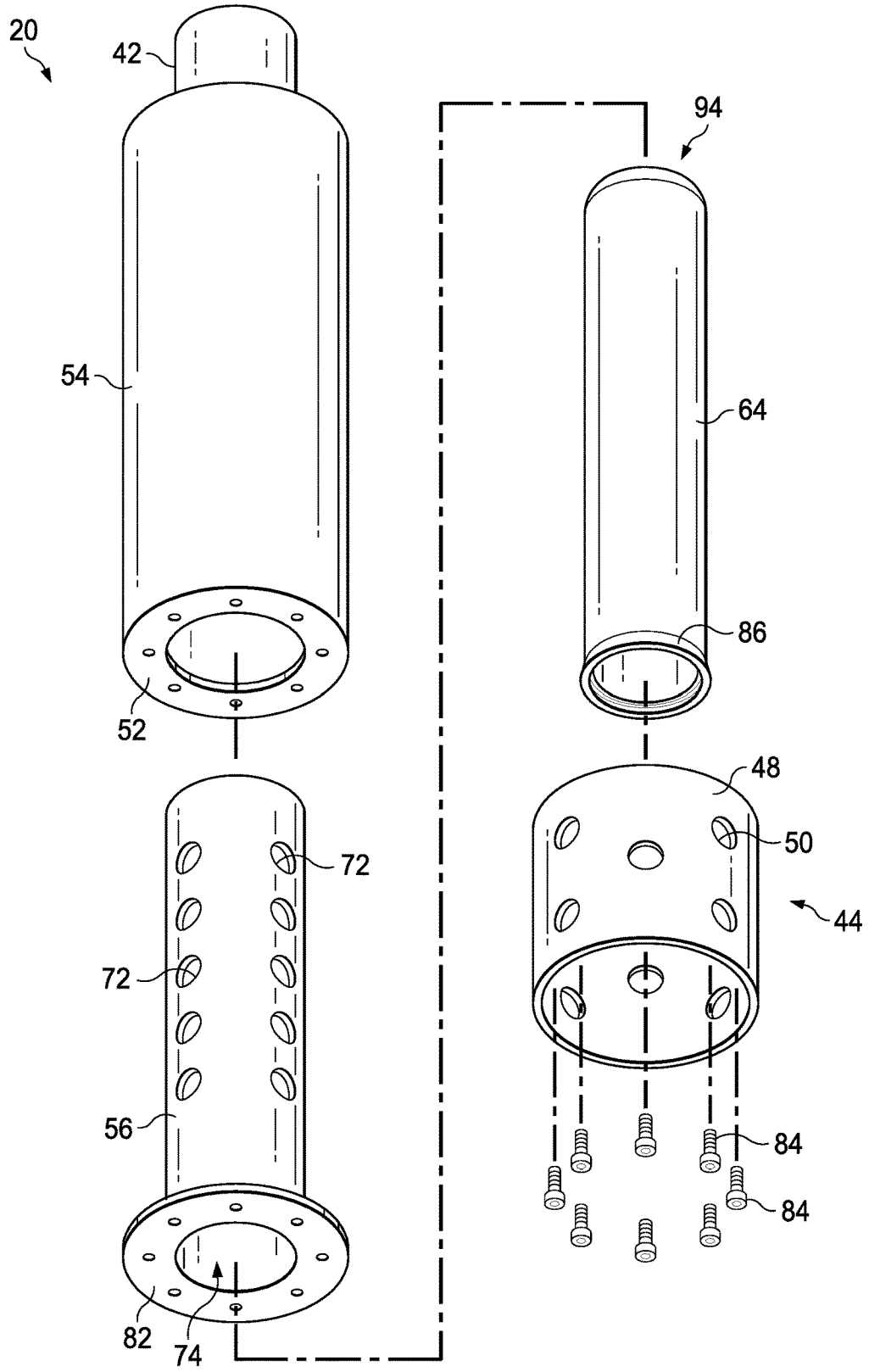
FIG. 4 is an illustration of an exploded, perspective view of the filter tool shown in FIGS. 1 and 2.

The perforated intake tube 48 is substantially cylindrical and has a diameter that is substantially the same as that of the outer casing 54. The intake tube 48 may be formed of a suitable metal material such as aluminum and includes longitudinally and circumferentially spaced perforations 50 therein, along with an open bottom end 62 that allow the gas-containing water solution 40 to be drawn therein and thence into the bottom and 74 of the inner tube 56. The intake tube 48 has an inwardly turned, circumferentially extending flange 96 which seats against the flange 82 at the bottom of the inner tube 56. As can be seen in FIGS. 2 and 4, fasteners such as cap screws 84 fasten together the stacked flanges 52, 82, and 96. Although not shown in the Figures, the perforated intake tube 48 may include a pre-filter which functions to filter out any solid materials in the solution 40.

The filter bag 64 allows the passage of vapor/gas therethrough but does not permit the passage of water. The filter bag 64 may be formed of a hydrophobic material that acts as a type of molecular sieve and is not adversely affected by the temperatures in chemicals typically found in the production of hydrocarbon gases from well formations. One such suitable material is Gortex®, although many other materials are possible. The filter bag 64 is generally cylindrical in shape, and comprises an inner layer 88, an outer layer 90 and a substantially rigid, circumferentially extending mouth 86 at its outer, open bottom end. The mouth 86 may be formed of polyethylene or other suitable plastic, and is joined to the inner and outer layers 88, 90 by any suitable means, such as by an adhesive. The opposite end 94 of the filter bag 64 is closed. The filter bag 64 is substantially flexible but, as will be described below in more detail, as a result of hydrostatic pressure, conforms to and substantially lines the interior walls of the inner tube 56. Thus, the rigid inner walls of the inner tube 56 forms a backing that supports and maintains the desired shape of the flexible filter bag 64, while reacting the hydrostatic pressure.

In one embodiment shown in FIG. 3, the outer layer 90 may comprise a semi-structural material such as a polyolefin felt or a polyester that allows the solution 40 to pass therethrough; other liquid permeable materials are possible. The inner layer 88 may comprise a coating of a semi-permeable material such as PTFE (polytetrafluoroethylene), for example Teflon®, or a variety of other materials that allow gas to pass therethrough while blocking passage of liquids such as water. In another embodiment shown in FIG. 3A, the inner layer 88 comprises the semi-structure material (e.g. felt or polyester), while the outer layer 90 comprises the semi-permeable material (e.g. PTFE). The porosity of the filter bag 64 will selected to suit the particular application. In one application, a coating of PTFE having pore sizes of between 0.3 and 0.8 microns was found to be suitable.

Referring particularly to FIG. 3, the rigid mouth 86 of the filter bag 64 is outwardly turned and seats against the flange 96 on the perforated intake tube 48, thereby limiting the movement, and fixing the longitudinal position of the filter bag 64 inside the inner tube 56. The flow of the solution 40 under hydrostatic pressure into and through the filter bag 64 forces the filter bag 64 to expand against and cover the inside walls of the inner tube 56. It may be appreciated, however, that because of the bag mounting arrangement described above, the filter bag 64 may be easily removed for repair or replacement without disassembling the remaining components of the filter tool 20.

As mentioned above, when inserted into the open end of the inner tube 56, the filter bag 64, under hydrostatic pressure, is forced against and lines the inside walls of the inner tube 56, forming an inner separation and filtration chamber 58 receiving the solution of gas and water drawn into the intake 44. The inner tube 56 assists in maintaining the shape of the filter bag 64, while protectively enclosing it and reacting the hydrostatic pressure forces the solution 40 through the filter bag 64. As best seen in FIG. 2, the outer walls of the inner tube 56 are spaced radially inward from the inner walls of the outer casing 54, forming an outer chamber 92 that is in communication with the pipe coupler 42. The assembly of the perforated intake tube 48, outer casing 54, and inner tube 56 are joined together by suitable fasteners 84 which extend through the stacked flanges 52, 82, 96, of the outer casing 54, inner tube 56 and perforated intake tube 48, respectively.

In use, the filter tool 20 is attached to the gas pipe 30 using the threaded coupler described above, by welding or by other means. The filter tool 20 is then displaced downwardly into the wellbore 22 to the location of a formation 26 containing a solution 40 of water and gas. Hydrostatic pressure within the wellbore 22 forces the solution 40 through the perforations 50 and open bottom end 62 of the perforated intake tube 48. As best seen in FIG. 3, the solution 40 then travels upwardly into the inner chamber 58 where it is forced through the layers 88, 90 of the filter bag 64. The filter bag 64 separates the gas 46 from the water, allowing only the gas 46 to pass through the filter bag 64. The gas 46 passing through the filter bag 64 flows laterally out through the perforations 72 in the inner tube 56, where it is collected within the outer chamber 92. The pressure within the outer chamber 92 is less than that within the inner chamber 58, aiding in withdrawing gas 46 through the filter bag 64. The gas 46 flows upwardly through the outer chamber 92 and passes through the slots 70 and pipe coupler 42 to the gas pipe 30 which delivers the gas to the well head 32.

Figure 5:
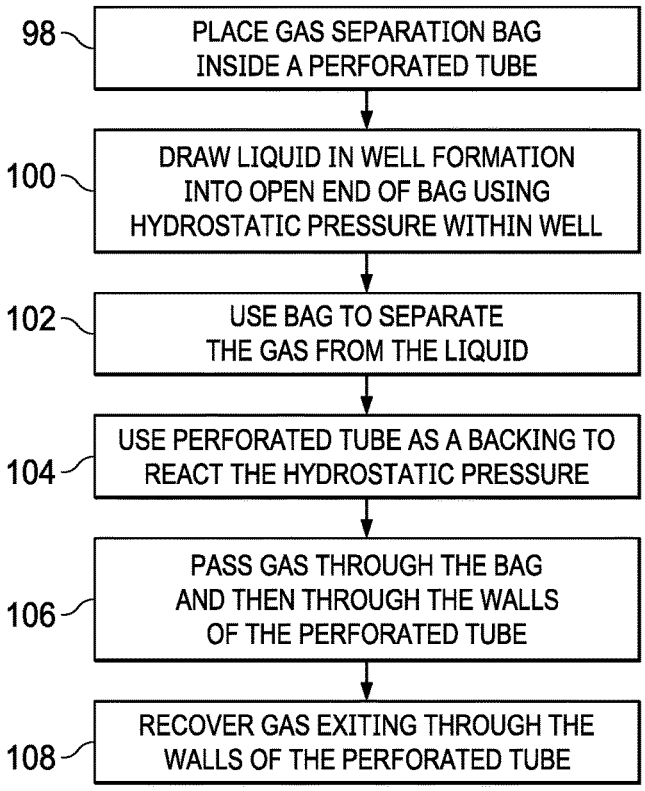
FIG. 5 is an illustration of a flow diagram of a method of separating gas from a liquid within a subterranean well formation.

FIG. 5 broadly illustrates the steps of a method of separating gas from a liquid within a subterranean well formation 26 using the filter tool 20 described above. At 98, a gas separation or filter bag 64 is placed inside a perforated inner tube 56. At 100, liquid such as a solution of gas and water within the well formation 26 is drawn into an open end of the filter bag 64 using hydrostatic pressure within the well. At 102, the filter bag 64 is used to separate the gas from the liquid. At 104, the perforated inner tube 56 is used as a backing to react the hydrostatic pressure forcing the liquid through the filter bag 64. At 106, gas passing through and separated by the filter bag 64 is then passed through the walls of the perforated inner tube 56. At 108, the gas exiting through the walls of the perforated inner tube 56 is recovered, as by drawing the gas through a gas pipe 30 to a well head 32.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different advantages as compared to other illustrative embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. Apparatus for separating gas from a solution containing gas and water in a well, comprising:

a filter bag having an open end allowing the solution to be received under hydrostatic pressure into the interior of the filter bag, the filter bag including a filtering material configured to separate the gas from the water;

a tube sleeved over the bag, the tube having an open end into which the filter bag may be received, and plurality of perforations therein configured to allow the gas to escape from the tube; and at least one flange, wherein the filter bag includes a substantially rigid mouth seated against the at least one flange.

2. The apparatus of claim 1, wherein the filter bag includes:

a supporting inner layer allowing the gas to pass therethrough, and an outer layer of the filtering material adhered to the supporting inner layer.

3. The apparatus of claim 2, wherein the supporting inner layer is one of:

felt, and polyester.

4. The apparatus of claim 2, wherein the filtering material is polytetrafluoroethylene.

5. The apparatus of claim 1 wherein the bag substantially lines and conforms to interior walls of the tube.

6. Apparatus for separating gas from a solution containing gas and water in a well, comprising:

a filter bag having an open end allowing the solution to be received under hydrostatic pressure into the interior of the filter bag, the filter bag including a filtering material configured to separate the gas from the water;

a tube sleeved over the bag, the tube having an open end into which the filter bag may be received, and plurality of perforations therein configured to allow the gas to escape from the tube; and an outer casing configured to be coupled with a gas pipe for removing a gas from the well, the outer casing surrounding and being spaced radially outward from the tube to define an outer chamber in which gas passing through the filter bag is accumulated for delivery to the gas pipe.

7. A wellbore tool, comprising:

a perforated intake tube configured to receive a solution containing gas and water within a well;

a perforated inner tube attached to the perforated intake tube for receiving the solution from the intake tube, the perforated inner tube defining an inner chamber;

a filter bag lining the inner chamber within the perforated inner tube, the filter bag including filtering material for separating the gas from the water; and a casing surrounding the perforated inner tube and defining an outer chamber in which the gas separated by the filter bag is received, wherein each of the perforated intake tube, the perforated inner tube, and the casing includes a flange, and the flanges are stacked and fastened together.

8. The wellbore tool of claim 7, further comprising:

a pipe coupler attached to the casing and coupled with the outer chamber, the pipe coupler being configured to be coupled with a gas pipe for removing gas from the wellbore tool.

9. The wellbore tool of claim 7, wherein:

the filter bag includes an open end provided with a substantially rigid mouth, and the rigid mouth is seated against one of the flanges.

10. The wellbore tool of claim 7, wherein:

the perforated intake tube includes a closed top end having perforations therein, and the casing includes a closed top spaced above the closed top end of the perforated intake tube and provided with perforations therein.

11. The wellbore tool of claim 7, wherein the filter bag includes:

a supporting inner layer allowing the gas to pass therethrough, and an outer layer of the filtering material adhered to the supporting inner layer.

12. The wellbore tool of claim 11, wherein the supporting inner layer is one of:

felt, and polyester.

13. The wellbore tool of claim 7, wherein the filtering material is polytetrafluoroethylene.

14. The wellbore tool of claim 7, wherein the perforated inner tube and the casing are cylindrical in shape and concentric with each other.

15. A wellbore tool, comprising:

a perforated intake tube configured to receive a solution containing gas and water within a well;

a perforated inner tube attached to the perforated intake tube for receiving the solution from the intake tube, the perforated inner tube defining an inner chamber;

a filter bag lining the inner chamber within the perforated inner tube, the filter bag including filtering material for separating the gas from the water, the filter bag being configured to be held against the inner tube by hydrostatic pressure and removable from the inner tube through the perforated intake tube; and a casing surrounding the perforated inner tube and defining an outer chamber in which the gas separated by the filter bag is received.

16. A wellbore tool, comprising:

a perforated intake tube configured to receive a solution containing gas and water within a well;

a perforated inner tube attached to the perforated intake tube for receiving the solution from the intake tube, the perforated inner tube defining an inner chamber and having an annular flange;

a filter bag lining the inner chamber within the perforated inner tube, the filter bag including filtering material for separating the gas from the water; and a casing surrounding the perforated inner tube and defining an outer chamber in which the gas separated by the filter bag is received, the casing including an annular flange, wherein the annular flange of the perforated inner tube and the annular flange of the casing are secured together.

* * * * *